US011982163B2

(12) United States Patent
Dyess et al.

(10) Patent No.: US 11,982,163 B2
(45) **Date of Patent: *May 14, 2024**

(54) MODULAR GUN SYSTEM

(71) Applicant: Hunting Titan, Inc., Pampa, TX (US)

(72) Inventors: Adam Dyess, Houston, TX (US); Christopher Brian Sokolove, Midlothian, TX (US); Ryan Bradley, Cypress, TX (US); Julio Cesar Veliz, Cypress, TX (US)

(73) Assignee: Hunting Titan, Inc., Pampa, TX (US)

( * ) Notice: Subject to any disclaimer, the term of this patent is extended or adjusted under 35 U.S.C. 154(b) by 206 days.

This patent is subject to a terminal disclaimer.

(21) Appl. No.: 17/632,493

(22) PCT Filed: Nov. 8, 2019

(86) PCT No.: PCT/US2019/060484

§ 371 (c)(1),
(2) Date: Feb. 2, 2022

(87) PCT Pub. No.: WO2021/025716

PCT Pub. Date: Feb. 11, 2021

(65) Prior Publication Data

US 2022/0282600 A1 Sep. 8, 2022

Related U.S. Application Data

(60) Provisional application No. 62/883,504, filed on Aug. 6, 2019.

(51) Int. Cl.
*E21B 43/118* (2006.01)
*E21B 43/117* (2006.01)
(Continued)

(52) U.S. Cl.
CPC ..... *E21B 43/1185* (2013.01); *E21B 43/117* (2013.01); *E21B 43/119* (2013.01)

(58) Field of Classification Search
CPC ..... E21B 43/11; E21B 43/116; E21B 43/117; E21B 43/119; E21B 43/1185; F42B 3/08; F42D 1/05; F42D 1/045
(Continued)

(56) References Cited

U.S. PATENT DOCUMENTS 4,502,550 A 3/1985 Ibsen
9,581,422 B2 * 2/2017 Preiss ..... F42C 19/12
(Continued)

FOREIGN PATENT DOCUMENTS

CN 101454635 A 6/2009
CN 104533355 A 4/2015
(Continued)

OTHER PUBLICATIONS

Notification of transmittal of the International Search Report and the Written Opinion of the International Searching Authority, or the Declaration, dated Mar. 5, 2020, PCT/US19/60484, 15 pages.

*Primary Examiner* — Joshua E Freeman

(57) ABSTRACT

A method and apparatus for coupling a pre-wired end fitting with a shaped charge loading tube where the end fitting centers and orients the loading tube within a perforating gun and further includes a selective switch, feed through contact and orifices to insert a wireless detonator and detonating cord, the loading tube being pre-wired with insulated wire.

25 Claims, 6 Drawing Sheets

(51) Int. Cl.
*E21B 43/1185* (2006.01)
*E21B 43/119* (2006.01)

(58) Field of Classification Search
USPC ..... 89/1.15
See application file for complete search history.

(56) References Cited

U.S. PATENT DOCUMENTS

| | | | | |
|---|---|---|---|---|
| 9,689,223 | B2 | 6/2017 | Schacherer et al. | |
| 10,429,161 | B2 * | 10/2019 | Parks | F42C 19/06 |
| 11,174,712 | B2 * | 11/2021 | Quattlebaum | E21B 43/1185 |
| 11,391,126 | B2 * | 7/2022 | Dyess | E21B 43/117 |
| 2010/0089643 | A1 * | 4/2010 | Vidal | E21B 43/117 175/2 |
| 2015/0330192 | A1 * | 11/2015 | Rogman | E21B 43/1185 166/297 |
| 2016/0084048 | A1 * | 3/2016 | Harrigan | E21B 43/119 175/4.57 |
| 2016/0168961 | A1 * | 6/2016 | Parks | E21B 43/1185 102/306 |
| 2017/0314373 | A9 * | 11/2017 | Bradley | F42D 1/043 |
| 2018/0299239 | A1 * | 10/2018 | Eitschberger | H05K 5/069 |
| 2019/0085664 | A1 * | 3/2019 | Hardesty | F16B 2/04 |
| 2019/0292887 | A1 * | 9/2019 | Austin, II | F42D 1/05 |
| 2021/0207934 | A1 * | 7/2021 | Sullivan | E21B 43/1185 |
| 2021/0223007 | A1 * | 7/2021 | Kash | E21B 43/1185 |

FOREIGN PATENT DOCUMENTS

| | | | |
|---|---|---|---|
| CN | 106062303 | A | 10/2016 |
| CN | 207453945 | U | 6/2018 |

* cited by examiner

MODULAR GUN SYSTEM

RELATED APPLICATIONS

This application claims priority to U.S. Provisional Application No. 62/883,504, filed Aug. 6, 2019.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well-known method in the art for accessing hydrocarbon deposits within a formation from a wellbore.

Explosively perforating the formation using a shaped charge is a widely known method for completing an oil well. A shaped charge is a term of art for a device that when detonated generates a focused output, high energy output, and/or high velocity jet. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates, the liner metal is compressed into a superheated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, an initiator at one end of the perforating gun can detonate all of the perforating charges in the gun and continue a ballistic transfer to the opposite end of the gun. In this fashion, numerous perforating guns can be connected end to end with a single initiator detonating all of them.

The detonating cord is typically detonated by an initiator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Charge tubes can be formed as tubes, strips, or chains. The charge tubes will contain cutouts called charge holes to house the shaped charges.

It is generally preferable to reduce the total length of any tools to be introduced into a wellbore. Among other potential benefits, reduced tool length reduces the length of the lubricator necessary to introduce the tools into a wellbore under pressure. Additionally, reduced tool length is also desirable to accommodate turns in a highly deviated or horizontal well. It is also generally preferable to reduce the tool assembly that must be performed at the well site because the well site is often a harsh environment with numerous distractions and demands on the workers on site.

Electric initiators are commonly used in the oil and gas industry for initiating different energetic devices down hole. Most commonly, 50-ohm resistor initiators are used. Other initiators and electronic switch configurations are common.

Modular or "plug and play" perforating gun systems have become increasingly popular in recent years due to the ease of assembly, efficiencies gained, and reduced human error. Most of the existing plug and play systems either (1) utilize a wired in switch and/or detonator, or (2) require an initiating "cartridge" that houses the detonator, switch, electrical contacts and possibly a pressure bulkhead. The wired in switch/detonator option is less desirable, because the gun assembler must make wire connections which is prone to human error. The initiating cartridge option is less desirable because the cartridge can be a large explosive device—in comparison to a standard detonator—thus takes up additional magazine space at the user facility. There is a need for a modular perforating system in which no wire connections are required by the user AND the switch and pressure bulkhead are in pre-assembled in the gun assembly rather than in the initiating cartridge. The detonator for the proposed system has no wires and allows for simple arming by the user in the field.

SUMMARY OF EXAMPLE EMBODIMENTS

An example embodiment may include a perforating gun system having a cylindrical housing with a bottom end and a top end, a prewired loading tube assembly disposed within the cylindrical housing and having a corresponding bottom end and top end, an upper end fitting coupled to the top end of the prewired loading tube and the top end of the cylindrical housing, a lower end fitting coupled to the bottom end of the prewired loading tube and the bottom end of the cylindrical housing, upper electrical connections coupled to the upper end fitting, lower electrical connections coupled to the bottom end fitting, a selective switch coupled to a detonator connector receptacle disposed within the upper end fitting, and a detonator electrically coupled to the selective switch and further disposed within the upped end fitting.

An alternative embodiment may include having the upper end fitting disposed within the pre-wired loading tube houses a selective switch in which the end fitting contains a portion to receive an auto-shunting modular detonator by electrically connecting it to a mating receptacle of a selective switch and affixing the auto-shunting modular detonator proximate to a detonating cord. It may include a means for auto-shunting the detonator. It may include coupling a baffle to the bottom end of the cylindrical housing. The prewired loading tube may further include an insulated wire which is terminated at the selective switch in the upper end and a pressure bulkhead coupled to the lower end. The selective switch may be grounded to the loading tube. The loading tube may be electrically connected to the baffle. It may include having shaped charges installed into the loading tube, in which the shaped charges are held in place by a locking means fixed to the shaped charge. It may include having a detonating cord coupled to the back of the shaped charges with a detonating cord locking means. The detonating cord may be terminated into a detonating cord orifice integral with the end fitting. The detonator may be located adjacent to the detonating cord in an end-to-end configuration. The detonator may have an auto-shunting feature that does not un-shunt until a mating receptacle is inserted. The selective switch may have a ribbon pigtail with the un-shunting receptacle attached. The receptacle connected to the switch may be attached to the end of the detonator, disengaging the shunt of the detonator.

An example embodiment may include a pre-wired shaped charge loading tube assembly having a cylindrical housing with a bottom end and a top end, an upper end fitting coupled to the top end of the prewired loading tube and the top end of the cylindrical housing, a lower end fitting coupled to the bottom end of the prewired loading tube and the bottom end of the cylindrical housing, upper electrical connections coupled to the upper end fitting, lower electrical connections coupled to the bottom end fitting, a selective switch coupled to a detonator connector receptacle disposed within the upper end fitting, and a detonator electrically coupled to the selective switch and further disposed within the upped end fitting.

An example embodiment may include a method of perforating a wellbore including coupling a pre-wired first end fitting with a first end of a shaped charge loading tube, coupling a pressure bulkhead at the first end fitting and the first end of the shaped charge loading tube, coupled a pre-wired second end fitting with a second end of a shaped charge loading tube, in which the second end fitting centers and orients the loading tube and embodies a selective switch, feed through contact and orifices to insert a wireless detonator from the outer end and detonating cord into the inner end, and pre-wiring the loading tube with insulated wire, wherein the wire is terminated at the selective switch in the second end fitting and the pressure bulkhead at the first end fitting.

An alternative embodiment may include centering the loading tube using the first end fitting within a perforating gun body. It may include electrically contacting the pre-installed insulated wire disposed within the loading tube to the pressure bulkhead contact adjacent. It may include pre-installing the baffle in the pin end of the gun carrier. It may include grounding the selective switch to the shaped charge loading tube. It may include inserting the shaped charges into the shaped charge loading tube. It may include locking the shaped charges into place within the shaped charge loading tube. It may include inserting detonating cord into the back of each shaped charge disposed within the shaped charge loading tube via locking features fixed to the shaped charge. It may include inserting the termination of a detonating cord into the end fitting. It may include inserting a wireless detonator into the end fitting from outside of the perforating gun assembly such that the explosive load end of the detonator is adjacent to the detonating cord in an end to end position. The wireless detonator may have an auto-shunting feature that does not un-shunt until a mating receptacle is inserted. The selective switch may have a ribbon pigtail with the un-shunting receptacle attached. It may include inserting the wireless detonator wherein the connector receptacle connected to the switch is attached to the end of the detonator, disengaging the shunt of the detonator. It may include screwing together the loaded perforating modular gun assemblies wherein the top contact makes electrical contact to the bottom contact of the adjacent gun assembly. It may include swaging and threading the outer diameter of a pin end of the perforating gun. It may include installing a pin by pin tandem sub into a box end of perforating gun assembly having a box by box gun body. It may include selectively initiating the detonator of the perforating gun. It may include pre-assembling spring-loaded top contact wires coupled to the selective switch. It may include connecting the through wire of the selective switch to the insulated wire of the loading tube. The output wires of the selective switch may be insulated ribbon or wires which has the detonator connector receptacle affixed to its end. It may include inserting the detonating cord through the inner end of the end fitting and a detonator from the outer end such that the detonator is adjacent to the detonating cord on the horizontal axis of the gun body. It may include overlapping the detonating cord and the detonator to form a side by side explosive coupling. It may include installing the pressure bulkhead into the baffle of the pin end of the gun carrier. It may include coupling the pressure bulkhead into a pin-by-pin tandem sub, wherein the tandem sub is inserted into the first end of the gun carrier. It may include coupling the pressure bulkhead into the second end of the gun carrier. It may include arming the perforating gun by inserting a wireless electric detonator, connector end facing up, into the end fitting detonator orifice. It may include attaching the selective switch to the pre-wired loading tube and wiring the detonator connector receptacle pass through to the upper end fitting. It may include connecting the insulated wire to the switch within the lower end fitting, in which the detonator connector receptacle wire runs the length of the loading tube and the receptacle end passes through the upper end fitting.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Terms such as booster may include a small metal tube containing secondary high explosives that are crimped onto the end of detonating cord. The explosive component is designed to provide reliable detonation transfer between perforating guns or other explosive devices, and often serves as an auxiliary explosive charge to ensure detonation.

Detonating cord is a cord containing high-explosive material sheathed in a flexible outer case, which is used to connect the detonator to the main high explosive, such as a shaped charge. This provides an extremely rapid initiation sequence that can be used to fire several shaped charges simultaneously.

A detonator or initiation device may include a device containing primary high-explosive material that is used to initiate an explosive sequence, including one or more shaped charges. Two common types may include electrical detonators and percussion detonators. Detonators may be referred to as initiators. Electrical detonators have a fuse material that burns when high voltage is applied to initiate the primary high explosive. Percussion detonators contain abrasive grit and primary high explosive in a sealed container that is activated by a firing pin. The impact of the firing pin is sufficient to initiate the ballistic sequence that is then transmitted to the detonating cord.

An example embodiment may comprise a modular perforating gun system in which the selective switch is embodied in the end fitting of the loading tube assembly of the perforating gun. The top or bottom end fitting is designed to hold a selective switch, a feed through contact and orifices to insert the detonator from one end and the detonating cord from the other. The opposite end fitting is designed to connect to a pressure bulkhead containing the feed through contact. Ground is made through charge tube to the end fitting to bulkhead to baffle to gun body. The loading tube is prewired and terminated to the pressure bulkhead feed through contact at one end and the selective switch at the other end. The gun carrier is box by pin with bottom of gun carrier having a swaged and threaded end. Alternatively, may have a thin shoulder pin-pin tandem sub.

Figure 1:
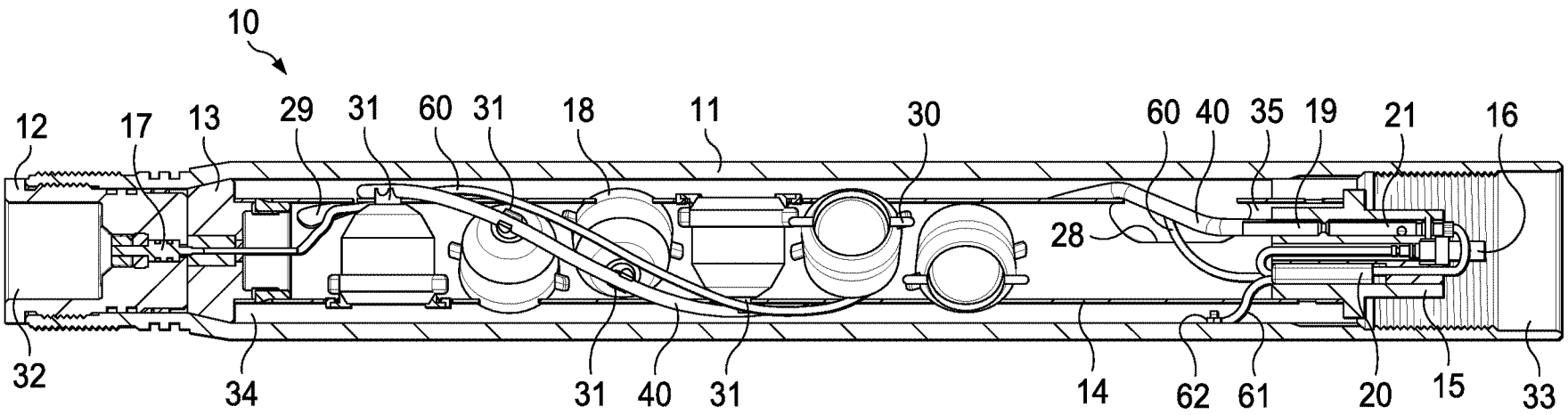
FIG. 1 shows an example embodiment of a modular gun system cross section.

An example embodiment is shown in FIG. 1. The example embodiment includes a perforating gun assembly 10 having a cylindrical body, in this case gun carrier 11, with a lower end 32 and an upper end 33. A baffle 12 with a pressure bulkhead bottom contact 17 disposed therein is further coupled to the lower end 32 of the cylindrical body 11.

A charge tube 14 is loaded with shaped charges 18 and disposed within, and coupled to, the gun carrier 11. In this example embodiment the charge tube 14 is pre-wired. The baffle 12 is adjacent to the bottom end fitting 13 which is coupled to the lower end 34 of the charge tube 14. A charge tube is also known as a loading tube. The charge tube 14 has loading tube cutouts 29 located proximate to the lower end 34 and loading tube cutouts 28 located proximate to the upper end 35. The charge tube 14 has a bottom end fitting 13 located proximate to the lower end 34 and a top end fitting 15 located proximate to the upper end 35. A locking means for shaped charges 18 may include the tabs 30 located on shaped charges 18. A detonator cord locking means may include the retainer fitting 31 located on the end of the shaped charges 18. The selective switch 20 is grounded to the cylindrical body via ground wire 61 coupled to grounding screw 62. Electrical conductor 60 is used to send signals through perforating gun 10 and is pre-wired into the charge tube 14. Electrical conductor 60 is insulated from the cylindrical body 11, which is conductive and acts as a ground. A detonating cord 40 is coupled to each of the shaped charges 18. A ground wire 61 from the selective switch 20 is coupled to the case gun carrier 11 via fastener 62.

Figure 2:
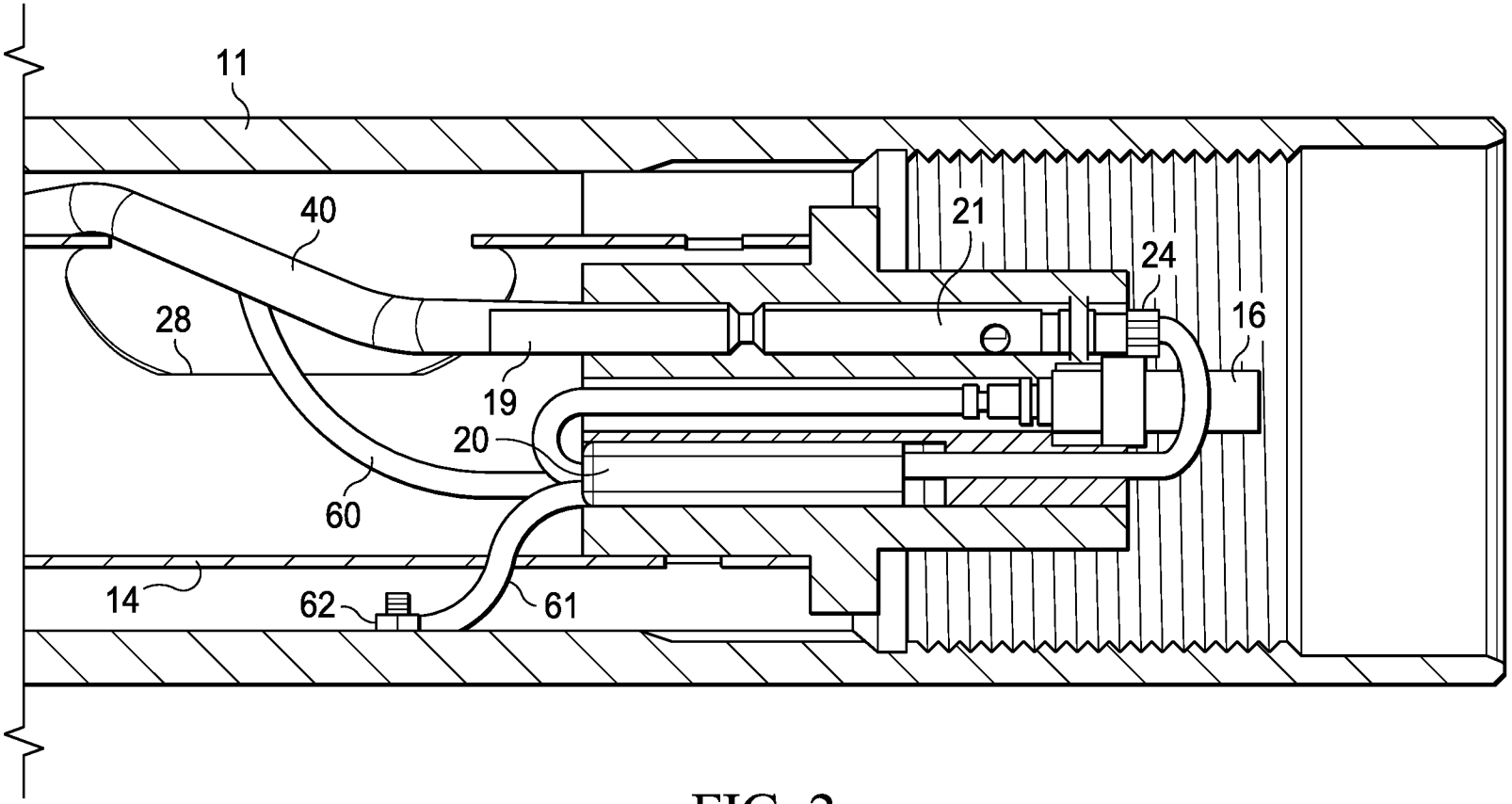
FIG. 2 shows a close up of an example embodiment of the end of a modular gun system cross section.

The top end fitting 15 includes a selective switch 20, a wireless detonator 21, a detonating cord orifice 19, and a top contact 16. A closer view of top end fitting 15 is shown in FIG. 2. The ground lug 25 allows the selective switch 20 to be grounded to the charge tube 14. The selective switch 20 is connected to the wireless detonator 21 via the detonator connector receptacle 24. The detonator connector receptacle 24 has an auto-shunting feature whereby the wireless detonator 21 is shunted until the correct connector is inserted. A detonating cord 40 wraps around the outside of the charge tube 14, connecting to all of the shaped charges 18 via connectors 31, and terminates within the charge tube 14, through the loading tube cutout 28, and into the detonating cord orifice 19, which is located proximate to the wireless detonator 21. The detonating cord 40 may be located in an end-to-end or side-by-side configuration with the wireless detonator 21.

Figure 3:
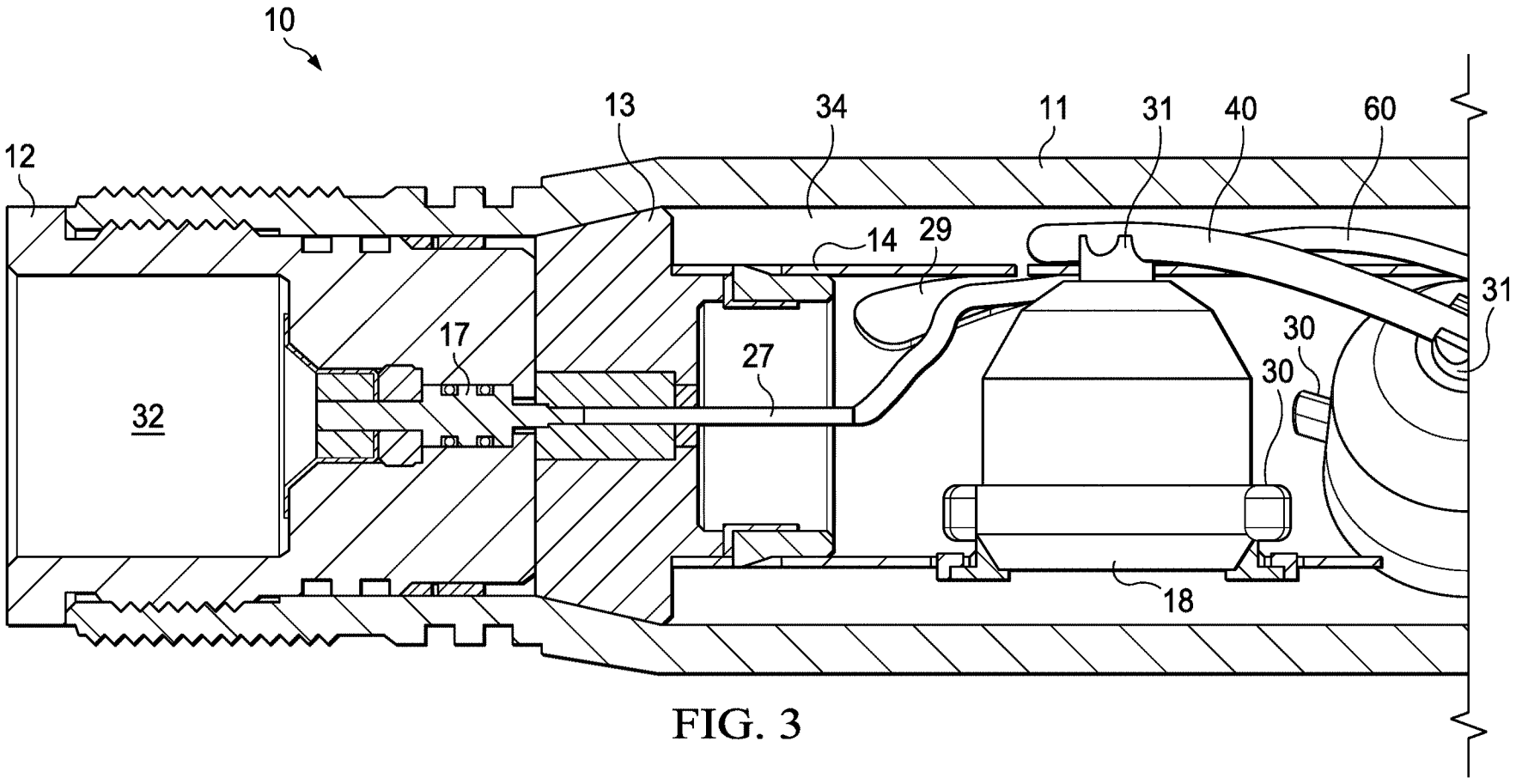
FIG. 3 shows an example embodiment of an end of a modular gun system cross section.

The lower end 32 of the perforating gun assembly 10 is shown in FIG. 3 including a baffle 12 coupled to the lower end 32 and located proximate to the lower end fitting 13. The pressure bulkhead bottom contact 17 is coupled to an insulated wire 27. The loading tube 14 includes shaped charges 18 having locking tabs 30 for locking into the loading tube 14. The shaped charges 18 have detonating cord locking clips 31 that couple to a detonating cord 40 wrapped along the outside of the loading tube 14.

Figure 4:
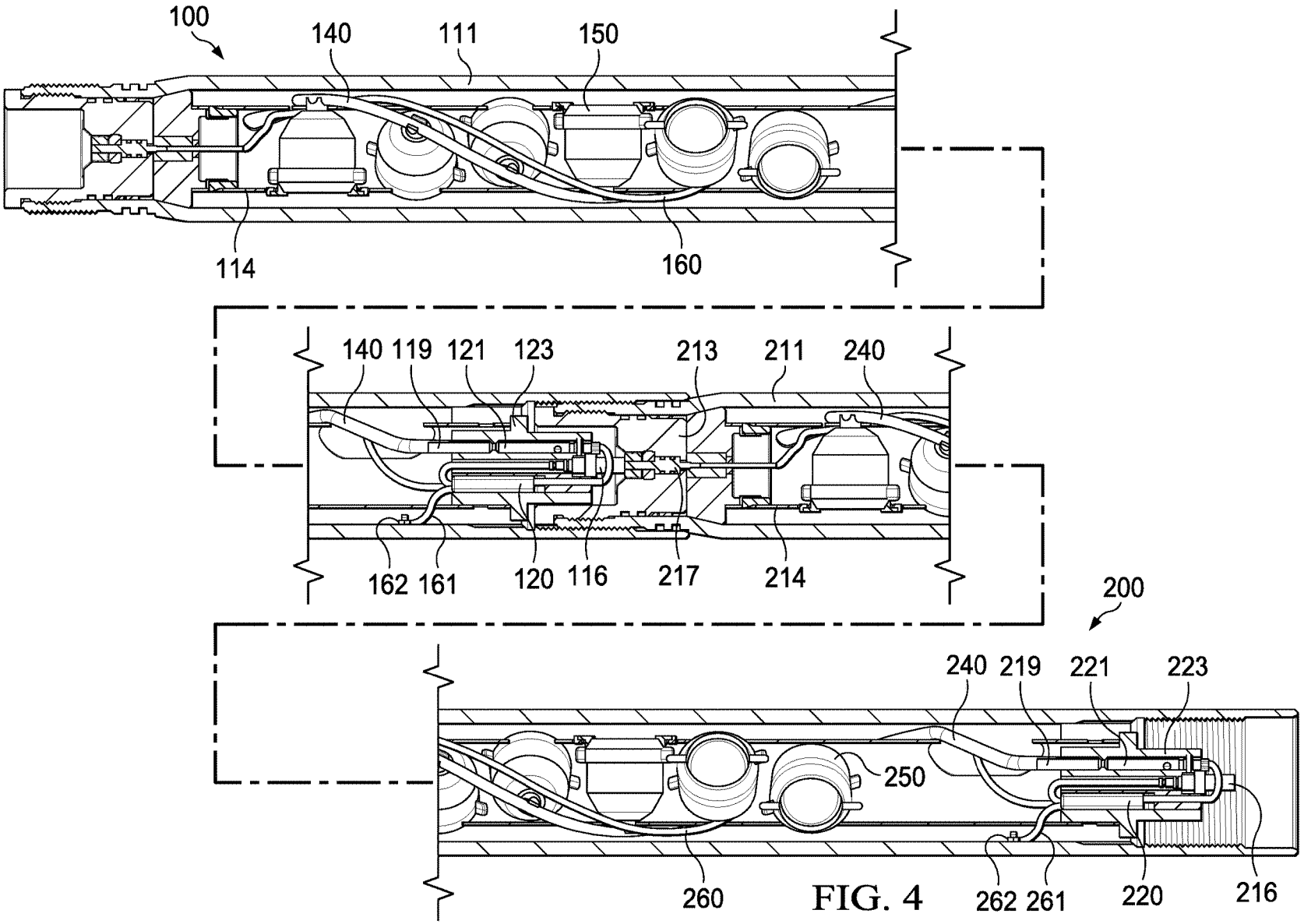
FIG. 4 shows an example embodiment of two modular perforating guns coupled together.
Figure 5:
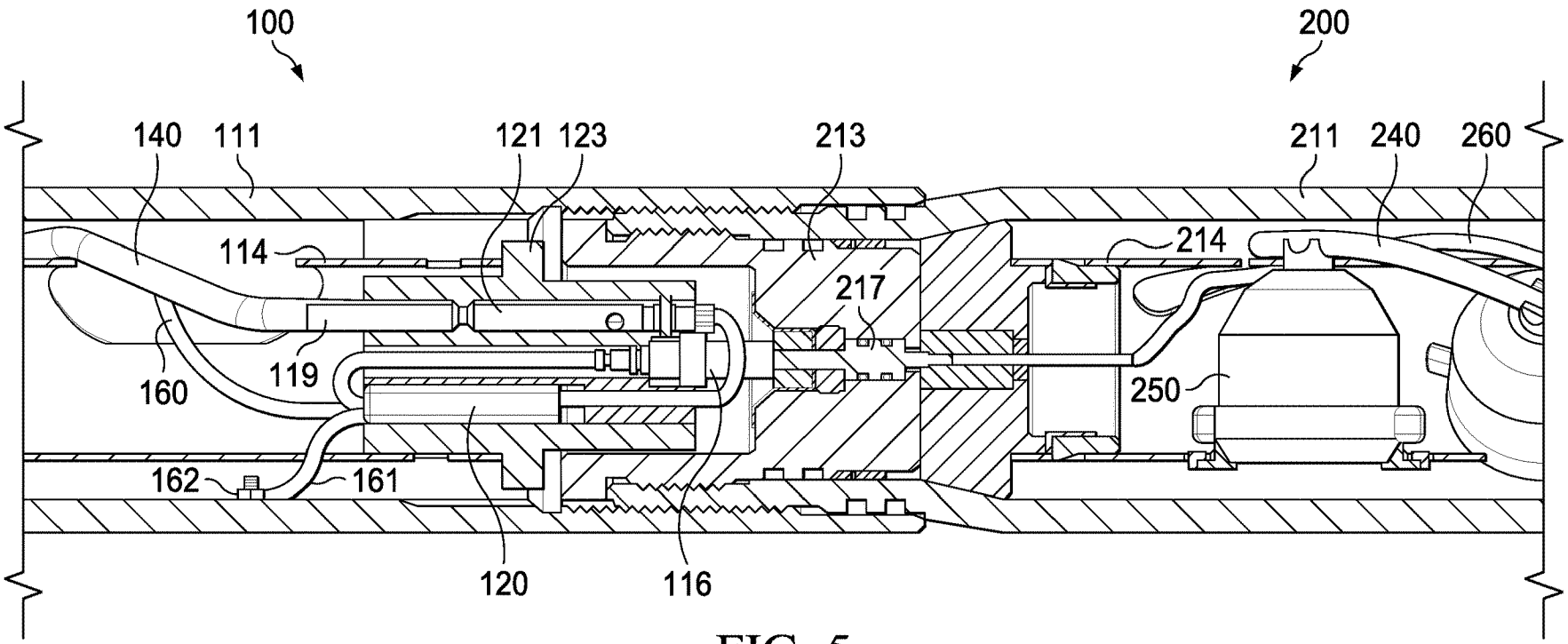
FIG. 5 shows a close up of coupling of an example embodiment where two modular perforating guns are coupled together.

Two perforating guns, a lower gun 100 and an upper gun 200 are shown in FIG. 4 and FIG. 5 depicting a close up of the gun-to-gun connection. The two perforating guns 100 and 200 are configured similarly and this example embodiment shows how the guns are coupled together. The perforating gun 100 has a charge tube 114 located within a cylindrical body 111. The charge tube 114 contains shaped charges 150 coupled to detonating cord 140 and an upper end fitting 123. Upper end fitting 123 contains a selective switch 120 coupled to a wireless detonator 121, which is further located adjacent to a detonating cord orifice 119. The upper contact 116 couples to the pressure bulkhead bottom contact 217 of perforating gun 200. Pressure Bulkhead bottom contact 217 is disposed within and coupled to bottom end fitting 213. Perforating gun 200 also contains a charge tube 214 located within a cylindrical body 211 and containing perforating charges 250 coupled to detonating cord 240. Perforating gun 200 also has an upper fitting 223 that contains a selective switch 220 coupled to a wireless detonator 221, which is further located adjacent to a detonating cord orifice 219. Upper connector 216 couples to the pressure bulkhead bottom contact of a possible third perforating gun. Electrical conductor 160 is used to send signals through perforating gun 100 and is pre-wired into charge tube. Electrical conductor 160 is insulated from the cylindrical body 111, which is conductive and acts as a ground. The selective switch 120 is grounded to the cylindrical body via ground wire 161 coupled to grounding screw 162. Electrical conductor 260 is used to send signals through perforating gun 200 and is pre-wired into charge tube. Electrical conductor 260 is insulated from the cylindrical body 211, which is conductive and acts as a ground. The selective switch 220 is grounded to the cylindrical body via ground wire 261 coupled to grounding screw 262.

Figure 6:
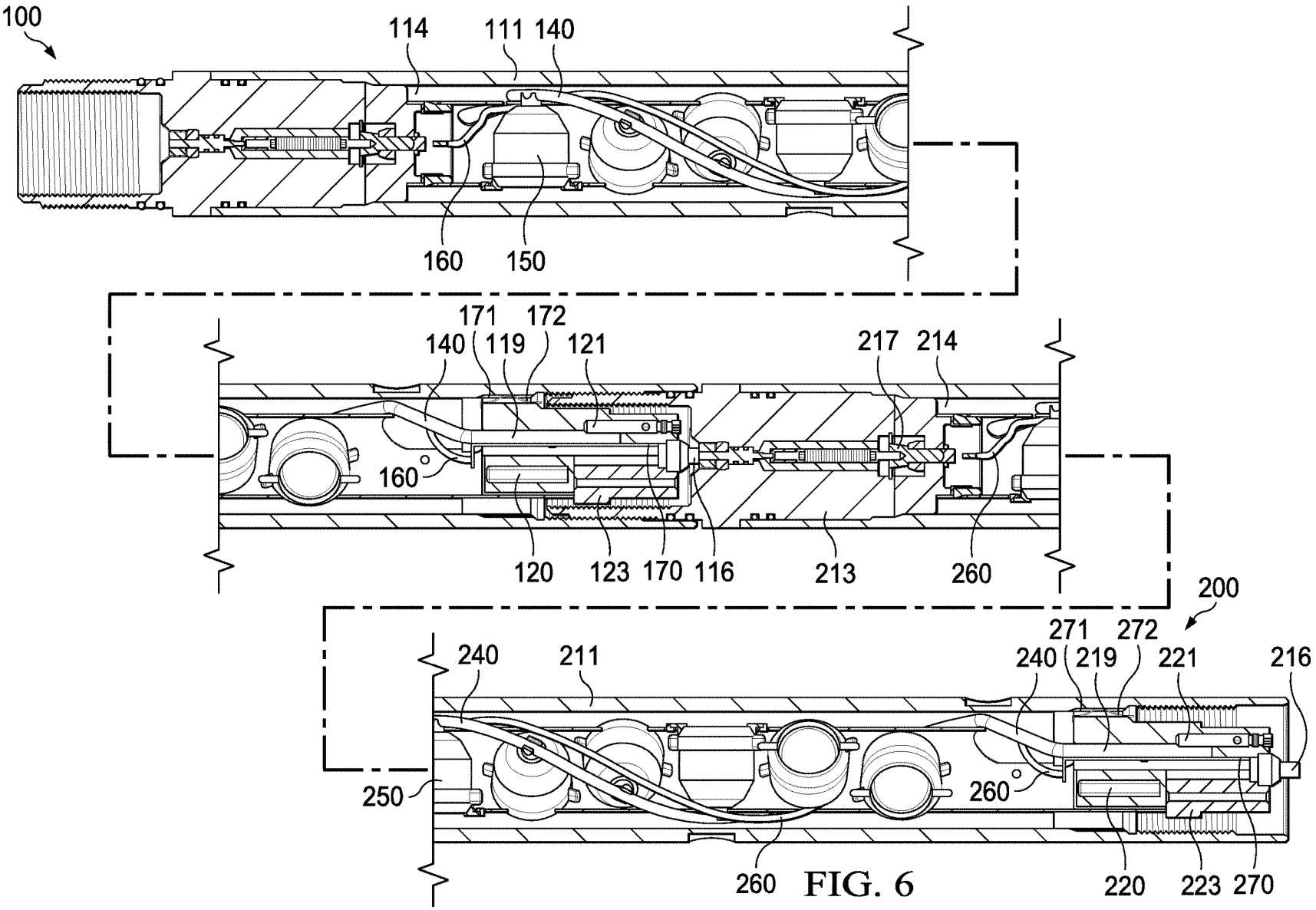
FIG. 6 shows an example embodiment of two modular perforating guns coupled together.

Two perforating guns, a lower gun 100 and an upper gun 200 are shown in FIG. 6 depicting a close up of the gun-to-gun connection. The two perforating guns 100 and 200 are configured similarly and this example embodiment shows how the guns are coupled together. The perforating gun 100 has a charge tube 114 located within a cylindrical body 111. The charge tube 114 contains shaped charges 150 coupled to detonating cord 140 and an upper end fitting 123. Upper end fitting 123 contains a selective switch 120 coupled to a wireless detonator 121, which is further located adjacent to a detonating cord orifice 119. Electrical contact 170 electrically couples the electrical conductor 160 with the upper contact 116. Ground spring 172 electrically grounds the selective switch 120 to the cylindrical body 111 in the ground recess 171. The upper contact 116 couples to the pressure bulkhead bottom contact 217 of perforating gun 200. Pressure Bulkhead bottom contact 217 is disposed within and coupled to bottom end fitting 213. Perforating gun 200 also contains a charge tube 214 located within a cylindrical body 211 and containing perforating charges 250 coupled to detonating cord 240. Perforating gun 200 also has an upper fitting 223 that contains a selective switch 220 coupled to a wireless detonator 221, which is further located adjacent to a detonating cord orifice 219. Electrical conductor 160 is used to send signals through perforating gun 100 and is pre-wired into charge tube. Electrical conductor 160 is insulated from the cylindrical body 111. Electrical conductor 260 is used to send signals through perforating gun 200 and is pre-wired into charge tube. Electrical conductor 260 is insulated from the cylindrical body 211, which is conductive and acts as a ground. Electrical contact 270 electrically couples the electrical conductor 260 with the upper contact 216. Ground spring 272 electrically grounds the selective switch 220 to the cylindrical body 211 in the ground recess 271. In this example embodiment the detonating cord 140 is coupled to detonating cord orifice 119, which is in a side-by-side configuration relative to the wireless detonator 121. In this example embodiment the detonating cord 240 is coupled to detonating cord orifice 219, which is in a side-by-side configuration relative to the wireless detonator 221.

Wireless detonator, as used in this specification, is defined as a detonator that is pre-wired prior to installation and does not require any wiring in the field to function. This wireless capability allows the detonator to become effectively a plug-and-play device that establishes the necessary electrical connections for its function by plugging it into the perforating gun.

The example embodiments disclose a modular gun system that is a box by pin design consisting of a steel loading tube with an end fitting pre-installed at each end. One end fitting centers and orients the loading tube and embodies a selective switch, feed through contact and orifices to insert a wireless detonator from the outer end and detonating cord into the inner end.

The loading tube is pre-wired with insulated wire which is terminated at the selective switch in one end fitting and the pressure bulkhead at the opposite end. The opposite end fitting centers the loading tube and provides electrical contact from the pre-installed insulated wire on the loading tube to the pressure bulkhead contact adjacent to the end fitting. The pressure bulkhead is pre-installed into a baffle in the pin end of the gun carrier. The selective switch is grounded to the loading tube which is electrically connected to the baffle which is threaded into the gun carrier.

Charges are inserted into the loading tube and held in place by locking features fixed to the shaped charge. Detonating cord is inserted into the back of each charge via locking features fixed to the shaped charge. The detonating cord terminates into the detonating cord orifice in the end fitting. A wireless detonator is inserted into the end fitting from outside of the gun assembly such that the explosive load end of the detonator is adjacent to the detonating cord in an end to end position. The wireless detonator has an auto-shunting feature that does not un-shunt until a mating receptacle is inserted.

The selective switch has a ribbon pigtail with the un-shunting receptacle attached. After inserting the wireless detonator, the connector receptacle connected to the switch is attached to the end of the detonator, disengaging the shunt of the detonator. The loaded and armed modular gun assemblies are screwed together such that the top contact makes electrical contact to the bottom contact of the adjacent gun assembly. The box by pin gun configuration is accomplished by swaging and threading the outer diameter of one end of the gun. Alternatively, the pin end is accomplished by installing a pin by pin tandem sub into one box end of a box by box gun body.

The end fitting is purposefully designed via a mold or machining method to house a selective switch designed to selectively initiate the detonator of a perforating gun. The end fitting is pre-assembled with a spring-loaded top contact wired to the input of the selective switch. The end fitting is pre-assembled such that the through wire of the selective switch is connected to the insulated wire pre-installed onto the loading tube. The end fitting is pre-assembled such that the output wires of the selective switch are insulated ribbon or wires which has the detonator connector receptacle affixed to its end. The end fitting is purposefully designed via a mold or machining method to insert detonating cord through the inner end and a detonator from the outer end such that the detonator is adjacent to the detonating cord on the horizontal axis of the gun body. Alternatively, the end fitting is designed such that the detonating cord and detonator overlap each other such that the end of the detonating cord and detonator are side by side.

The pressure bulkhead is pre-installed into the baffle of the pin end of the gun carrier. Alternatively, the pressure bulkhead is pre-installed into the pin by pin tandem sub which is inserted into one end of the gun carrier. Alternatively, the pressure bulkhead is pre-installed to the end of the charge tube end fitting. The gun assembly is armed by inserting a wireless electric detonator, connector end facing up, into the end fitting detonator orifice, followed by attaching the connector receptacle attached to the end fitting into the outer end of the detonator.

The selective switch is attached to, or contained within, the pre-wired loading tube and the wires with the detonator connector receptacle pass through the upper end fitting. The selective switch is contained within the lower end fitting, wherein the insulated wire is connected to the switch within the same lower end fitting and the detonator connector receptacle wire runs the length of the loading tube and the receptacle end passes through the upper end fitting.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A perforating gun system comprising:

a cylindrical housing with a bottom end and a top end;

a prewired loading tube assembly disposed within the cylindrical housing and having a corresponding bottom end and top end;

an upper end fitting coupled to the top end of the prewired loading tube and the top end of the cylindrical housing;

a lower end fitting coupled to the bottom end of the prewired loading tube and the bottom end of the cylindrical housing;

upper electrical connections coupled to the upper end fitting;

lower electrical connections coupled to the bottom end fitting;

a selective switch coupled to a detonator connector receptacle disposed within the upper end fitting;

a detonator electrically coupled to the selective switch and further disposed within the upped end fitting;

wherein the detonator has an auto-shunting feature that does not un-shunt until a mating receptacle is inserted; and wherein the selective switch has a ribbon pigtail with the un-shunting receptacle attached.

2. The prewired loading tube assembly of claim 1, wherein the upper end fitting disposed within the pre-wired loading tube houses a selective switch wherein the upper end fitting contains a portion to receive an auto-shunting modular detonator by electrically connecting it to a mating receptacle of the upper end fitting selective switch and affixing the auto-shunting modular detonator proximate to a detonating cord.

3. The perforating gun system of claim 1, further comprising a means for auto-shunting the detonator.

4. The perforating gun system of claim 1, further including coupling a baffle to the bottom end of the cylindrical housing.

5. The perforating gun system of claim 1, wherein the prewired loading tube further comprises an insulated wire which is terminated at the selective switch in the upper end and a pressure bulkhead coupled to the lower end.

6. The perforating gun system of claim 1, wherein the selective switch is grounded to the loading tube.

7. The perforating gun system of claim 6, wherein the loading tube is electrically connected to a baffle.

8. The perforating gun system of claim 1, further including shaped charges installed into the loading tube, wherein the shaped charges are held in place by a locking means fixed to the shaped charge.

9. The perforating gun system of claim 8, further comprising a detonating cord coupled to the back of the shaped charges with a detonating cord locking means.

10. The perforating gun system of claim 9, wherein the detonating cord terminates into a detonating cord orifice integral with the upper end fitting or the lower end fitting.

11. The perforating gun system of claim 10, wherein the detonator is located adjacent to the detonating cord in an end-to-end configuration.

12. The perforating gun system of claim 1, wherein the receptacle connected to the switch is attached to the end of the detonator, disengaging the shunt of the detonator.

13. A pre-wired shaped charge loading tube assembly comprising:

a cylindrical housing with a bottom end and a top end;

an upper end fitting coupled to a top end of the prewired loading tube and the top end of the cylindrical housing;

a lower end fitting coupled to a bottom end of the prewired loading tube and the bottom end of the cylindrical housing;

upper electrical connections coupled to the upper end fitting;

lower electrical connections coupled to the bottom end fitting;

a selective switch coupled to a detonator connector receptacle disposed within the upper end fitting; and a detonator electrically coupled to the selective switch and further disposed within the upped end fitting, wherein the detonator has an auto-shunting feature that does not un-shunt until a mating receptacle is inserted.

14. The pre-wired shaped charge loading tube assembly of claim 13, wherein the upper end fitting disposed within the pre-wired loading tube houses a selective switch wherein the upper end fitting contains a portion to receive an auto-shunting modular detonator by electrically connecting it to a mating receptacle of the upper end fitting selective switch and affixing the auto-shunting modular detonator proximate to a detonating cord.

15. The pre-wired shaped charge loading tube assembly of claim 13, further comprising a means for auto-shunting the detonator.

16. The pre-wired shaped charge loading tube assembly of claim 13, further including coupling a baffle to the bottom end of the cylindrical housing.

17. The pre-wired shaped charge loading tube assembly of claim 13, wherein the prewired loading tube further comprises an insulated wire which is terminated at the selective switch in the upper end and a pressure bulkhead coupled to the lower end.

18. The pre-wired shaped charge loading tube assembly of claim 13, wherein the selective switch is grounded to the loading tube.

19. The pre-wired shaped charge loading tube assembly of claim 18, wherein the loading tube is electrically connected to a baffle.

20. The pre-wired shaped charge loading tube assembly of claim 13, further including shaped charges installed into the loading tube, wherein the shaped charges are held in place by a locking means fixed to the shaped charge.

21. The pre-wired shaped charge loading tube assembly of claim 20, further comprising a detonating cord coupled to the back of the shaped charges with a detonating cord locking means.

22. The pre-wired shaped charge loading tube assembly of claim 21, wherein the detonating cord terminates into a detonating cord orifice integral with the upper end fitting or the lower end fitting.

23. The pre-wired shaped charge loading tube assembly of claim 22, wherein the detonator is located adjacent to the detonating cord in an end-to-end configuration.

24. The pre-wired shaped charge loading tube assembly of claim 13, wherein the selective switch has a ribbon pigtail with the un-shunting receptacle attached.

25. The pre-wired shaped charge loading tube assembly of claim 24, wherein the receptacle connected to the switch is attached to the end of the detonator, disengaging the shunt of the detonator.

* * * * *